US007673764B2

(12) United States Patent
Sabold

(10) Patent No.: US 7,673,764 B2
(45) Date of Patent: Mar. 9, 2010

(54) CONTAINER WITH NARROW RIB

(75) Inventor: Bret Sabold, Bernville, PA (US)

(73) Assignee: Graham Packaging Company, L.P., York, PA (US)

( * ) Notice: Subject to any disclaimer, the term of this patent is extended or adjusted under 35 U.S.C. 154(b) by 778 days.

(21) Appl. No.: 11/363,213

(22) Filed: Feb. 28, 2006

(65) Prior Publication Data

US 2007/0199918 A1 Aug. 30, 2007

(51) Int. Cl.
*B65D 1/46* (2006.01)

(52) U.S. Cl. ..... 215/381; 215/365; 215/383; 220/669; 220/675

(58) Field of Classification Search ..... 215/379–383, 215/365; 220/669–671, 675
See application file for complete search history.

(56) References Cited

U.S. PATENT DOCUMENTS

| | | | | |
|---|---|---|---|---|
| 3,889,834 | A * | 6/1975 | Harris, Jr. | 215/10 |
| 4,782,945 | A * | 11/1988 | Geiler et al. | 206/203 |
| 4,863,046 | A | 9/1989 | Collette et al. | |
| 5,054,632 | A | 10/1991 | Alberghini et al. | |
| 5,141,121 | A | 8/1992 | Brown et al. | |
| 5,238,129 | A | 8/1993 | Ota | |
| 5,279,433 | A | 1/1994 | Krishnakumar | |
| 5,303,833 | A | 4/1994 | Hayashi et al. | |
| 5,337,909 | A | 8/1994 | Vailliencourt | |
| 5,704,504 | A * | 1/1998 | Bueno | 215/381 |
| 6,016,932 | A | 1/2000 | Gaydosh et al. | |
| 6,036,037 | A | 3/2000 | Scheffer et al. | |
| 6,062,409 | A | 5/2000 | Eberle | |
| 6,068,161 | A * | 5/2000 | Soehnlen et al. | 222/143 |
| D443,521 | S | 6/2001 | Bansal et al. | |
| 6,347,717 | B1 | 2/2002 | Eberle | |
| 6,390,316 | B1 | 5/2002 | Mooney | |
| 6,460,714 | B1 | 10/2002 | Silvers et al. | |
| D466,813 | S | 12/2002 | Thierjung et al. | |
| 6,585,125 | B1 | 7/2003 | Peek | |
| 6,616,001 | B2 | 9/2003 | Saito et al. | |
| 6,779,673 | B2 * | 8/2004 | Melrose et al. | 215/381 |
| 6,837,390 | B2 | 1/2005 | Lane et al. | |
| 6,857,531 | B2 | 2/2005 | Slat et al. | |
| 6,932,230 | B2 | 8/2005 | Pedmo et al. | |
| 6,935,525 | B2 | 8/2005 | Trude | |
| 2004/0016716 | A1 | 1/2004 | Melrose et al. | |
| 2004/0159628 | A1 | 8/2004 | Trude | |
| 2005/0029220 | A1 | 2/2005 | Onoda et al. | |

(Continued)

FOREIGN PATENT DOCUMENTS

| | | | |
|---|---|---|---|
| DE | 9112620 | U1 | 4/1992 |

(Continued)

OTHER PUBLICATIONS

Written Opinion of PCT/US2007/005003 addressing the above cited foreign patent documents.

*Primary Examiner*—Sue A Weaver
(74) *Attorney, Agent, or Firm*—Knoble Yoshida & Dunleavy, LLC

(57) ABSTRACT

A substantially smooth container sidewall containing a narrow vertical rib, the rib having a width that is less than about 35% of the diameter of the sidewall, a container including the substantially smooth sidewall, and method of making both the sidewall and the container are the subject of the present invention.

20 Claims, 5 Drawing Sheets

U.S. PATENT DOCUMENTS

| | | | | |
|---|---|---|---|---|
| 2005/0035083 | A1 | 2/2005 | Pedmo et al. | |
| 2005/0051509 | A1 | 3/2005 | Bysick et al. | |
| 2005/0092708 | A1 | 5/2005 | Heisner et al. | |
| 2005/0121408 | A1 | 6/2005 | Deemer et al. | |
| 2005/0150859 | A1 | 7/2005 | Lane et al. | |
| 2006/0175284 | A1* | 8/2006 | Noll et al. | 215/382 |

FOREIGN PATENT DOCUMENTS

| | | | |
|---|---|---|---|
| EP | 095030 | A2 | 11/1999 |
| EP | 1179482 | A1 | 2/2002 |
| FR | 2398671 | | 2/1979 |
| WO | 0189934 | | 9/2007 |

* cited by examiner

CONTAINER WITH NARROW RIB

BACKGROUND OF THE INVENTION

1. Field of the Invention

The present invention relates generally to a hot-fillable or pasteurizable, blow-molded container, and more particularly to a hot-fillable or pasteurizable, blow molded container having a narrow structural support rib in the sidewall.

2. Description of Related Art

Known blow-molded containers suited to hot-fill applications are usually made of plastic and employ flex panels and/or ribs that reinforce the integrity of the container while accommodating internal changes in pressures and volume in the container as a result of heating and cooling.

In order to obtain the necessary strength to withstand the manufacturing process, known plastic hot-fillable containers tend to be formed with indented and/or protruding rib structures that surround panels forming the container. While such rib structures improve the strength of the container that is blow-molded, ribs and other support structures pose various challenges for manufacture, handling, aesthetics, and use of the container. For example, such support structures disrupt the sidewall surface and make labeling the container difficult. Angular crevices and protrusions that result from indented and recessed ribs or panels also complicate product removal. Additionally, multiple support structures can be rather cumbersome, making handling of the container difficult. During manufacture, facilitating movement of hot plastic around crevices and protrusions is tedious. The additional support structures also add weight to the container, thus increasing manufacturing costs.

Accordingly, a hot-fillable, blow-molded container and process of manufacturing same is needed to provide a container that has a greater amount of smooth surface area for more convenient, efficient manufacture and handling of the container.

BRIEF SUMMARY OF THE INVENTION

The present invention is directed to a sidewall for a hot-fillable or pasteurizable plastic container, the sidewall including a vertical rib. The vertical rib can include a substantially flat recessed portion, and an edge wall connecting the recessed portion of the rib to the container sidewall. The sidewall can also have a label mounting area surrounding the rib, and the rib can have a width that is less than approximately 35% of the diameter of the sidewall. In one embodiment, the width of the rib is about 15-20% of the diameter of the sidewall.

The rib can extend substantially the full length of the container sidewall. In one embodiment the length of the rib can be 85-97% of the length of the sidewall. In another embodiment, the sidewall can include two or more ribs that are symmetrically dispersed through the sidewall.

The sidewall can include a substantially flat panel. In one exemplary embodiment, the sidewall has four panels, with each panel having a narrow vertical rib placed approximately in the center of the container. The width of the rib can be about 25-30% of the width of panel, and the length of the rib can be approximately 85-97% of the length of the panel. The panel also can be configured to flex in response to an internal change in pressure that results when the container is filled with a hot substance, capped, and allowed to cool. The panel is also adapted to flex in response to pressure changes that result when the container is filled with a cool or room temperature liquid, capped, and heated by any conventional pasteurization process.

The present invention is further directed to a container including the sidewall described above. The shape of the container can be polygonal or cylindrical.

Also included in the invention is a method of processing, the method including providing a container having a substantially smooth sidewall, the sidewall having a width and a narrow, vertical rib with a width, the sidewall having a label mounting area surrounding the rib, wherein the width of the rib is less than about 35% of the diameter of the sidewall; filling the container with a substance; heating the substance, sealing the container; and allowing at least a portion of the sidewall to flex inwardly or outwardly in response to pressure changes that occur during the filling process. The method can also include placing a label on the container.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

The present invention is directed to a sidewall 108 that is adapted for use in a plastic container 100 capable of withstanding a hot-fill or pasteurization process, and also to a container 100 that includes the sidewall 108. In order to more easily illustrate the practical applications of the present invention, the attached figures illustrate a complete container. The container 100 illustrated in FIGS. 1-5 is substantially square, but the invention is also directed to containers having other shapes. For example the container may be any polygonal shape, or it can be cylindrical. The container can also be asymmetrical. Furthermore, the invention is suited to containers of various styles, such as a container having a grip design.

Figure 1:
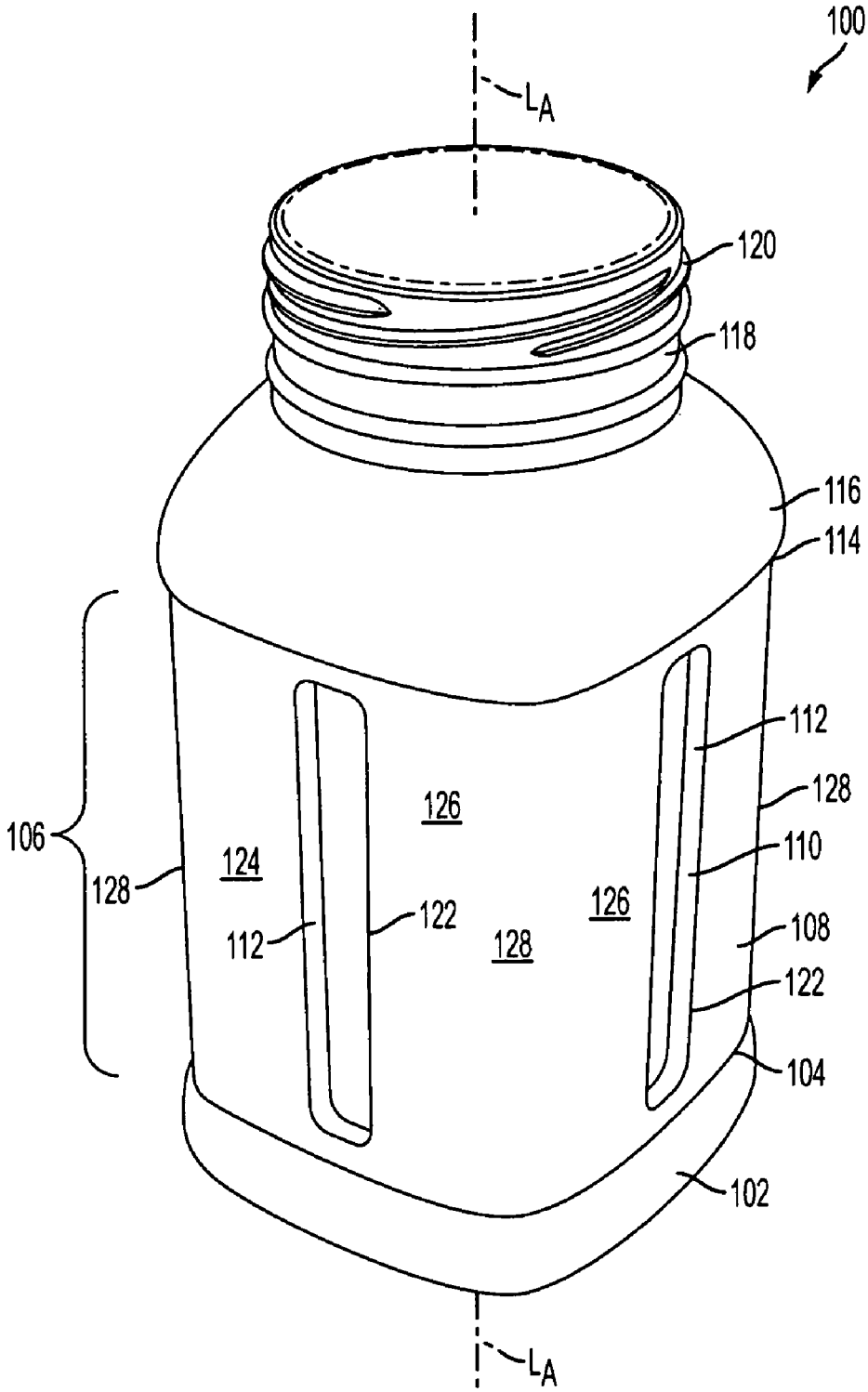
FIG. 1 depicts a perspective view of the container according to one embodiment of the present invention.
Figure 2:
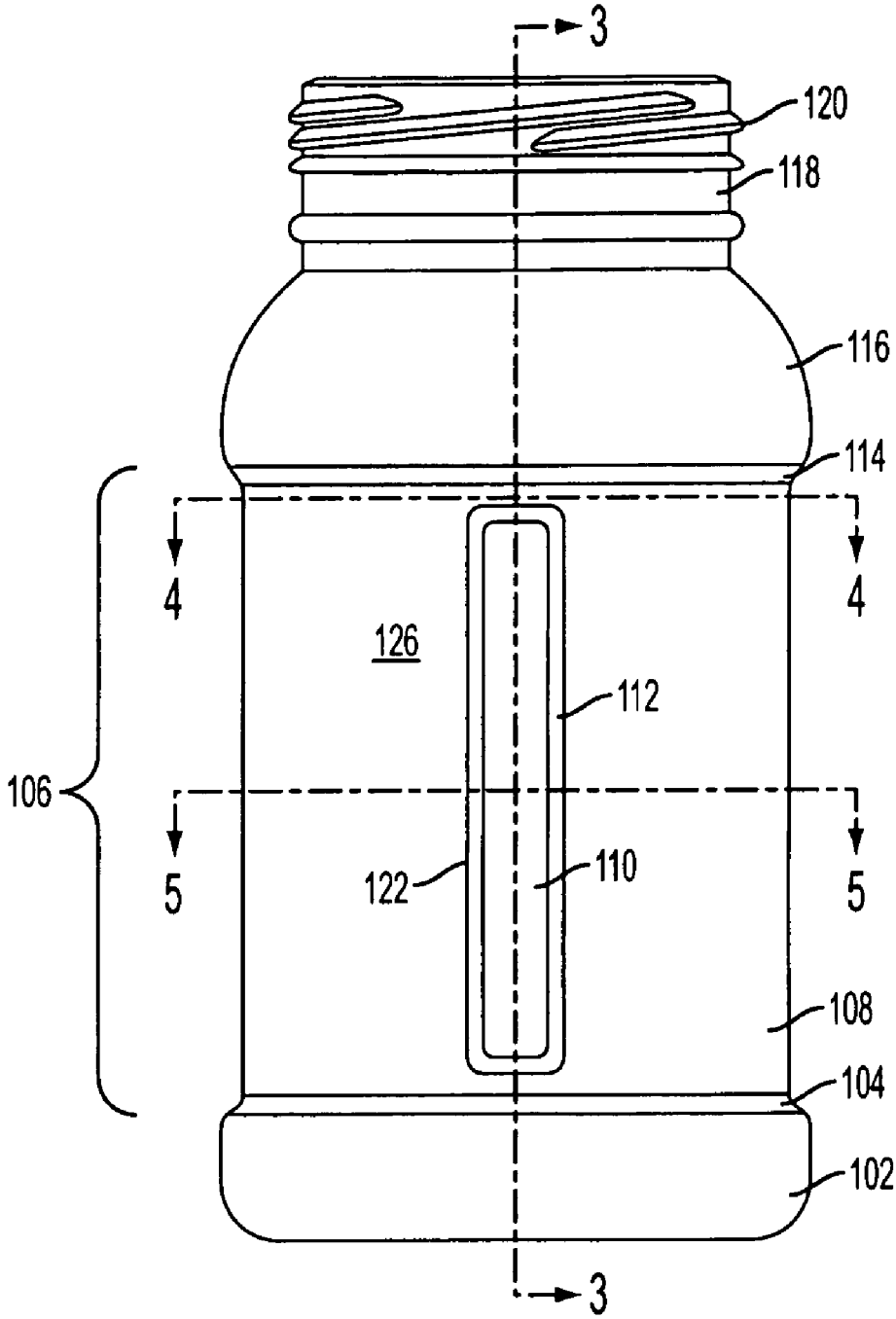
FIG. 2 depicts a front view of the container according to one embodiment of the present invention.

The container 100 generally comprises a base 102, shoulder 116, and a body portion 106 positioned between the base 102 and the shoulder 116. The body portion includes a sidewall 108. The body portion 106 can also include a lower ridge 104 and an upper ridge 114. In such an embodiment, the sidewall 108 extends between the lower ridge 104 and upper ridge 114. As shown in FIG. 2, the base 102 and shoulder 116 can be wider than sidewall 108. In the illustrated figures, lower ridge 104 provides a transition for the change in width from base 102 to sidewall 108. Similarly, upper ridge 114 provides a transition from the sidewall 108 to shoulder 116. The width of the base 102 and the shoulder 116 can be identical, nearly equal, or disparate. As shown in the FIGS. 1-3, the invention can include a neck 118, having a finish such as threads 120, allowing for attachment of a cap to the container 100.

The sidewall 108 contains a narrow rib 122. In the illustrated figures, the rib 122 is located in the center of the sidewall 108, but the rib 122 can be present anywhere in the sidewall 108. The rib 122 can have a substantially flat recessed portion 110. This substantially flat recessed portion is substantially free of structural features such as grooves, indents, or ridges. However, the substantially flat recessed portion can include decorative features or product identification features such as a product logo. The recessed portion 110 can be connected to the sidewall 108 by edge wall 112 which extends between the recessed portion of the rib 122 and the container sidewall 108.

Figure 3:
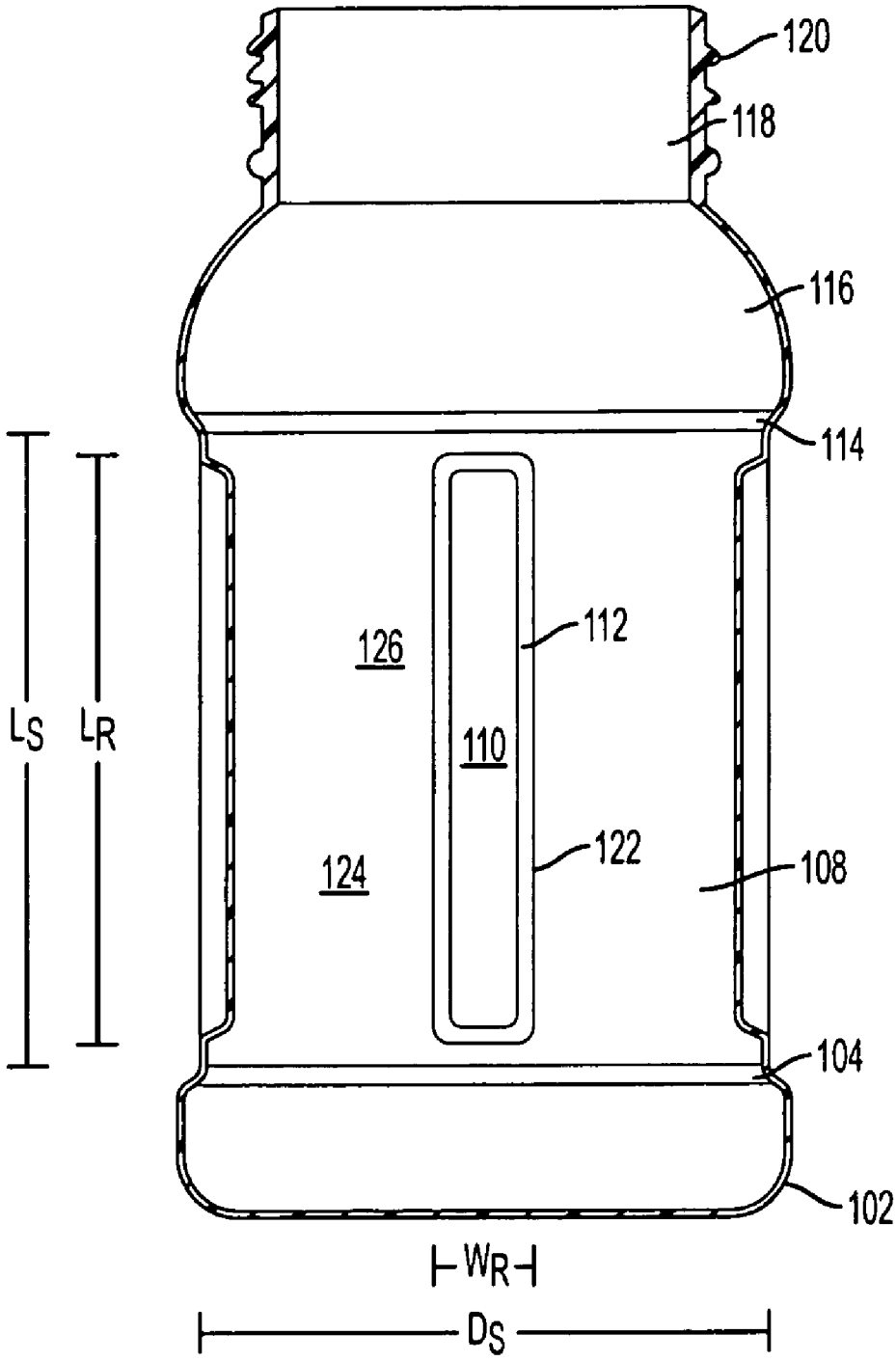
FIG. 3 shows a cross section of the container of FIG. 2 along line 3-3.
Figure 4:
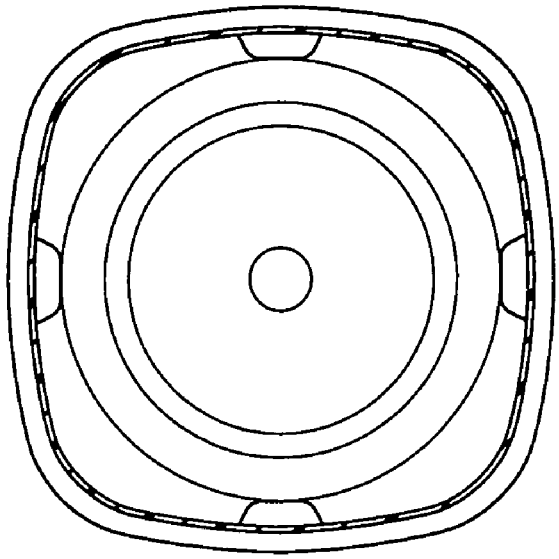
FIG. 4 shows a cross section of the container of FIG. 2 along line 4-4.

The rib 122 has a length $L_R$, which is the distance between points of the rib where the edge wall 112 meets the sidewall 108, as shown in FIG. 3. The length $L_R$ of rib 122 is measured along the longitudinal axis $L_A$ of the container 100. (See also FIG. 1.) The sidewall 108 has a length $L_S$, which is the distance between points at the uppermost and lowermost portions of the sidewall 108. For example, the length $L_S$ can extend from a point where the sidewall 108 meets the upper ridge 104 to a point where the sidewall 108 meets lower 114 ridge.

The length $L_R$ of the rib 122 can vary. As shown in FIGS. 1-3, rib 122 can extend substantially the full length of the sidewall 108. In some embodiments, particularly where the container is relatively tall and slender, the rib 122 can extend into the shoulder 116 or base 102. The length $L_R$ of the rib 122 can be approximately 80-100% of the length $L_S$ of the sidewall 108. Alternatively, the length $L_R$ of the rib 122 can be approximately 82-98% or approximately 92-97% of the length $L_S$ of the sidewall 108.

Rib 122 also has a width $W_R$, measured between the points where the edge wall 112 meets the sidewall 108, as shown in FIG. 3. The width $W_R$ of rib 122 is measured in a direction perpendicular to the longitudinal axis $L_A$ of the container 100. The sidewall 108 has a diameter $D_S$, which is also indicated in FIG. 3. The width of the rib, $W_R$, is less than about 35% of the diameter $D_S$ of the sidewall 108. Alternatively, the width of the rib can be approximately less than about 30%, less than about 25%, or less than about 20% of the diameter $D_S$ of the sidewall 108. For example, the width of the rib $W_R$ can be approximately 10%-30% or approximately 15-20% of the diameter $D_S$ of the sidewall 108.

FIGS. 1-5 illustrate an embodiment of a symmetric container with four sides, each side having a panel, each panel having a rib. One of the advantages of the present invention is particularly evident in these embodiments of the container having a square shape. Many of the rib structures in the prior art designed for round containers are difficult to produce in square-shaped containers. The rib 122 of the present invention is advantageous in that it can be utilized in containers of all shapes. For example, a container embodying the present invention may have any number of sides (polygonal) or none at all (oval, cylindrical), and there can be one rib for the entire container sidewall or multiple ribs, arranged either symmetrically or asymmetrically. In a multisided container, a rib 122 can be located in one portion of sidewall 108 on one side of the container 100, and another side can have the rib 122 located in a different area of the side.

As shown in the figures, sidewall 108 can include a substantially flat panel 126. The number of panels on the container may vary; for example, there can be only one panel 126 per container, there can be one panel 126 for each side of the container, panels 126 on alternating sides, no panels 126 at all, or any suitable combination. In embodiments containing a panel 126, the rib 122 can be situated in the panel 126. In the illustrated embodiment, the container 100 has four sides with one panel 126 per side. Panels 126 can be connected by a corner 128 that extends between adjacent panels 126. Four corners 128 are present in the illustrated embodiment, but the number of corners can vary with the shape of the container. For instance, a five-sided container can have five corners. As an alternative, a container could include two panels 126 interconnected by an arcuate portion of the sidewall 108. In this embodiment, the container 100 would have two rounded sides that bow outwardly or inwardly and connect the two substantially flat panels 126. Other panel and rib arrangements are included within the scope of this invention. For example, in a multi-sided container, a panel can be present on a sidewall without the existence of a rib on that particular side.

Figure 5:
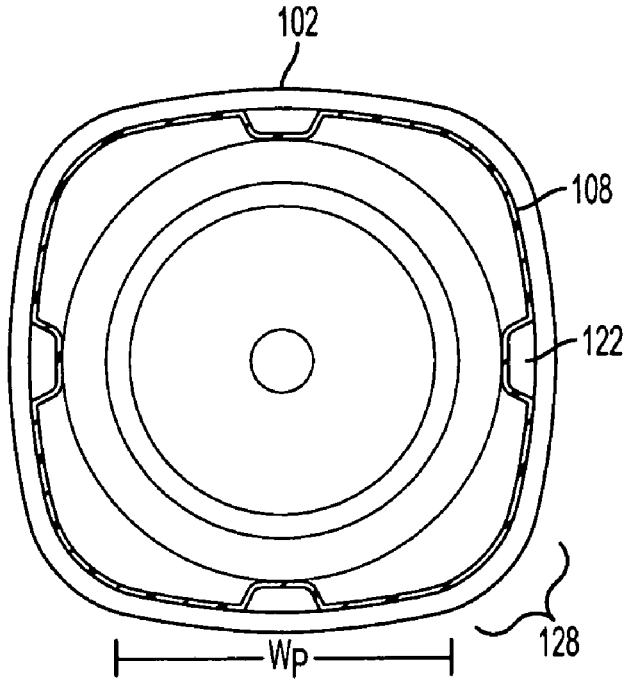
FIG. 5 shows a cross section of the container of FIG. 2 along line 5-5.

As shown in FIG. 5, panel 126 has a width, $W_P$. In one embodiment of the invention, the width of the rib $W_R$, can be approximately 15-35% or approximately 25-30% of the width of the panel $W_P$.

The sidewall 108 and container 100 have a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties.

The present invention is also directed to the method of making the container described herein. The step of providing the container can include utilizing a container that is premanufactured or by manufacturing the container, for example, by blow molding. The blow molding process can include extrusion, stretch or injection blow molding.

In extrusion blow molding, a molten tube of thermoplastic material, or plastic parison, is extruded between a pair of open blow mold halves. The blow mold halves close about the parison and cooperate to provide a cavity into which the parison is blown to form the container. As formed, the container can include extra material, or flash, at the region where the molds come together, or extra material, or a moil, intentionally present above the container finish. After the mold halves open, the container drops out and is then sent to a trimmer or cutter where any flash of moil is removed.

In stretch blow molding, a preformed parison, or preform, is prepared from a thermoplastic material, typically by an injection molding process. The preform typically includes a threaded end, which becomes the threads of the container. Alternatively, the threaded finish can be formed is formed during blow molding. The perform is positioned between two open blow mold halves. The blow mold halves close about the preform and cooperate to provide a cavity into which the preform is blown to form the container. After molding, the mold halves open to release the container. If the container is a wide-mouth container, the container is then sent to a trimmer where the moil, or extra plastic material above the blown finish, is removed.

Figure 6:
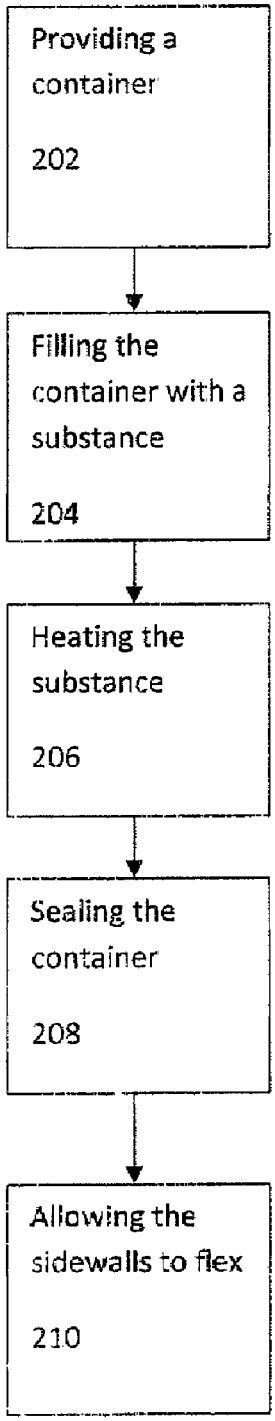
FIG. 6 shows a flow chart of the method used in accordance with the present invention.

Referring now to FIG. 6, in which a flow chart of the method used in accordance with the present invention is shown, in step 202 a container is provided. The present method further includes the step 204 of filling the container with a hot substance made hot from a step of heating 206, sealing the container, and allowing the sidewall 108 to flex in response to vacuum pressure. The hot liquid for filling the container includes food products such as beverages, sauces, condiments, and the like. The step 208 of sealing the container may be accomplished by, for instance, placing a flexible seal such as a foil seal on the container, placing a cap on the container, or both. The method is also directed to filling a container with an unheated substance, for example a cool or room temperature substance, sealing and/or capping the container, heating the container according to any known pasteurization process, and the step 210 of allowing the sidewall to flex in response to internal pressure. The method of the present invention can additionally include the steps of placing a label on the label mounting surface 124 and allowing the container to cool.

The sidewall 108 of the present invention, or at least portions thereof, is designed to flex inwardly and outwardly in response to pressure that is created during processing, for example, during hot-fill and pasteurization processing. Specifically, the interaction between the rib 122 and the panel 126 and/or sidewall stabilizes the sidewall 108, thus preventing the container 100 from undergoing undesirable distortion or collapsing, while still allowing portions of the sidewall 108 to flex inwardly or outwardly in response to the pressure changes that occur during hot-fill or pasteurization. The rib 122 enables the sidewall 108 and the container 100 to withstand forces in the downward direction so that the container 100 does not collapse during hot-filling or pasteurization. Additionally, the rib 122 enables movement of the sidewall 100 to compensate for negative (inward) pressure on the sidewall that results once the hot-filled container 100 is sealed. The rib is 122 also able to move to accommodate positive (outward) pressure created during the pasteurization process, for example, by flexing outwardly.

One advantage of the present invention is that sidewall 108 can be substantially smooth. That is, aside from the presence of the narrow rib 122, the sidewall 108 is substantially free of grooves, indentations, ridges, vacuum panels, or other such structures. This substantially smooth portion of the sidewall 108 provides a label mounting area 124. The label mounting area 124 is able to receive a label without hindering the appearance of the label, so that the label doesn't bunch or crinkle once put on the container 100. This also provides a large area for attachment and gluing, this improving the security of the label to the container. A smooth label will also enable a purchaser to read the label information such as ingredients and nutritional information.

A large amount of smooth sidewall surface area allows for a clear or translucent container where the customer can see the product without the distortion created by ribs, non-flat panels, and other disruptive structures. A clear container is particularly desirable when purchasing an item such as a sauce, shake, or condiment, allowing the user determine characteristics such as color, consistency, and individual components (for example, fruits or vegetables).

The elimination of complex support structures not only makes for a more attractive container, it makes for a container that is easier to manufacture, is less expensive, and easier to handle when compared with products that are currently available. For instance, the simplified geometry of the present container sidewall 108, including the narrow rib structure 122, facilitates manufacturing by eliminating the grooves and angles of other support structures that are difficult to extrude plastic into and around. The total amount of plastic required for manufacturing is also reduced. Another notable benefit is that the substantially smooth sidewall is less bulky and lighter in weight, reducing manufacturing costs.

The simplified structure of the present sidewall 108 and container 100 is advantageous to a user during emptying of contents. Particularly with food products that are of a thicker consistency, it can be difficult to extract a product when the sidewall contains ridges or grooves that can trap the product. Product removal is tedious and results in an undesirably high percentage of wasted product. With the single rib 122 as the support structure in the present invention, there is less area, if any, for a product to become trapped during emptying of the container. Therefore, the present invention facilitates effective product withdrawal, optimizes product use, and minimizes costs.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container comprising:

a base;

a body portion including: a substantially smooth sidewall having a diameter and a length, the sidewall containing a narrow vertical rib;

a label mounting area surrounding the rib; and a shoulder, wherein a width of the rib is approximately 15-20 percent of the diameter of the sidewall.

2. The container of claim 1, wherein the rib extends substantially the full length of the sidewall.

3. The container of claim 1, wherein the vertical rib has a substantially flat recessed portion and an edge wall connecting the recessed portion to the sidewall.

4. The container of claim 1, wherein the sidewall comprises a substantially flat panel.

5. The container of claim 4, wherein the container is symmetrical and comprises at least two panels with interconnecting round corners adjacent to and extending between the panels.

6. The container of claim 4, wherein the sidewall has four panels and each of the panels has at least one rib.

7. The container of claim 4, wherein the panel has a width such that the width of the rib is approximately 25-30 percent of the width of the panel.

8. The container of claim 1, wherein at least a portion of the sidewall is configured to flex in response a change in pressure resulting from a hot fill or pasteurization process.

9. The container of claim 4, wherein the panel and rib each have a vertical length, and the vertical length of the rib is approximately 85-97 percent of the length of the panel.

10. The container of claim 1, wherein the shape of the container is cylindrical.

11. A sidewall for a hot-fillable or pasteurizable plastic container, the sidewall having a diameter and a length, the sidewall comprising:

a narrow, vertical rib having a width, a substantially flat recessed portion, and an edge wall connecting the recessed portion to the sidewall;

a panel;

and a label mounting area surrounding the rib, wherein the width of the rib is less than about 15-20 percent of the diameter of the sidewall; wherein the panel has a width such that the width of the rib is approximately 25-30 percent of the width of the panel.

12. The sidewall of claim 11, wherein the vertical rib extends substantially the full length of the sidewall.

13. The sidewall of claim 11, wherein the panel is a substantially flat panel.

14. The sidewall of claim 11, wherein the sidewall comprises four panels and each panel has a vertical rib placed approximately in the center of the panel.

15. The sidewall of claim 11 wherein the panel and rib each have a vertical length, and the vertical length of the rib is approximately 85-97 percent of the length of the panel.

16. The sidewall of claim 11, wherein the panel is configured to flex in response to pressure changes within the container during filling and processing.

17. A processing method comprising:

providing a container having a substantially smooth sidewall, the sidewall having a diameter, and a narrow, vertical rib with a width, the sidewall having a label mounting area surrounding the rib, wherein the width of the rib is approximately about 15-20 percent of the diameter of the sidewall;

filling the container with a substance;

heating the substance;

sealing the container; and allowing at least a portion of the sidewall to flex in response pressure changes in the container cools.

18. The method of claim 17, wherein the step of heating the substance is performed before the steps of filling the container and sealing the container, and further comprising cooling the container and substance such that the sidewall flexes inwardly in response to vacuum pressure.

19. The method of claim 17, wherein the step of heating the substance is performed after the steps of filling the container and sealing the container such that the sidewall flexes outwardly in response to internal pressure.

20. The method of claim 17, further comprising placing a label on the container.

* * * * *